US008360558B2

(12) United States Patent
Hirai et al.

(10) Patent No.: US 8,360,558 B2
(45) Date of Patent: Jan. 29, 2013

(54) LIQUID DROPLET DISCHARGING HEAD AND LIQUID DROPLET DISCHARGING APPARATUS

(75) Inventors: Eiju Hirai, Minamiminowa-mura (JP); Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 12/944,968

(22) Filed: Nov. 12, 2010

(65) Prior Publication Data

US 2011/0115855 A1 May 19, 2011

(30) Foreign Application Priority Data

Nov. 17, 2009 (JP) ..... 2009-261582

(51) Int. Cl.
*B41J 2/045* (2006.01)

(52) U.S. Cl. ..... 347/70

(58) Field of Classification Search ..... 347/70
See application file for complete search history.

(56) References Cited

U.S. PATENT DOCUMENTS 7,497,557 B2 * 3/2009 Sugahara ..... 347/68

FOREIGN PATENT DOCUMENTS

JP 2005-088441 4/2005

* cited by examiner

*Primary Examiner* — Kevin S Wood
(74) *Attorney, Agent, or Firm* — Workman Nydegger

(57) ABSTRACT

A liquid droplet discharging head includes a pressure chamber substrate having a pressure chamber in communication with a nozzle hole. The pressure chamber has compartments adjacent to one another in a first direction. A vibrating plate has a first surface for covering the pressure chamber and a second, opposite, surface. The vibrating plate has a first area surface as a part of the first surface, the first area surface covering the pressure chamber in a view in a second direction that is orthogonal to the first direction and is normal to the first surface. A first conductive layer is formed at a plurality of areas to cover, in a view in the second direction.

9 Claims, 12 Drawing Sheets

LIQUID DROPLET DISCHARGING HEAD AND LIQUID DROPLET DISCHARGING APPARATUS

This application claims a priority to Japanese Patent Application No. 2009-261582 filed on Nov. 17, 2009 which is hereby expressly incorporated by reference herein in its entirety.

BACKGROUND

1. Technical Field

The present invention relates to a liquid droplet discharging head and a liquid droplet discharging apparatus.

2. Related Art

As a component of a liquid droplet discharging apparatus such as an ink-jet printer, a liquid droplet discharging head that includes a piezoelectric element for ejecting liquid such as ink in the form of droplets is known. For example, the piezoelectric element stretches and shrinks to deform a diaphragm plate when a driving signal is supplied thereto. This causes a pressure change in a pressure chamber that is formed under the piezoelectric element. As a result, the liquid supplied to the pressure chamber is discharged as droplets through a nozzle hole. To protect the piezoelectric substance layer of a piezoelectric element, which is susceptible to damage due to effects of ambient conditions such as, for example, moisture in the air, an upper electrode covers the piezoelectric substance layer in a structure of related art. An example of such a structure is disclosed in JP-A-2005-88441.

An elastic film 50 and an insulator film 55 that make up a diaphragm plate are shown in FIG. 3 of JP-A-2005-88441. In the illustrated structure, the thickness of the insulator film 55 tends to be reduced because it is subjected to over-etching in the processes of the patterning of a lower electrode, the piezoelectric substance, and the upper electrode. Therefore, there is a possibility that the diaphragm plate cracks when the piezoelectric element is driven for a long time.

SUMMARY

An advantage of some aspects of the invention is to provide a liquid droplet discharging head and a liquid droplet discharging apparatus that prevent the cracking of a diaphragm plate and offer improved durability.

(1) A liquid droplet discharging head according to an aspect of the invention includes a pressure chamber substrate, a vibrating plate, a first conductive layer, a piezoelectric substance layer, and a second conductive layer. A pressure chamber that is in communication with a nozzle hole is formed in the pressure chamber substrate. The pressure chamber is formed in the pressure chamber substrate as a plurality of compartments adjacent to one another in a first direction. The vibrating plate has a first surface for covering the pressure chamber and a second surface as an opposite surface. The vibrating plate has a first area surface as a part of the first surface. The first area surface covers the pressure chamber in a view in a second direction that is orthogonal to the first direction and is normal to the first surface. The first conductive layer is formed at a plurality of areas to cover, in a view in the second direction, the second surface of the vibrating plate inside each area that overlaps the first area surface in the first direction and, in a view in the second direction, extends from the area overlapping the first area surface to an area that is located outside the area overlapping the first area surface at least one side in a third direction to cover the second surface thereat. The third direction is orthogonal to both the first direction and the second direction. The piezoelectric substance layer covers the first conductive layer at least inside the area overlapping the first area surface in a view in the second direction. The second conductive layer covers, in a view in the second direction, at least a part of the piezoelectric substance layer in such a manner that the second conductive layer lies over the first conductive layer in the first direction and lies over a part of the first conductive layer in the third direction at least inside the area overlapping the first area surface. The second conductive layer lies over the first conductive layer formed at the plurality of areas in a view in the second direction. At least one of the first conductive layer, the second conductive layer, and the piezoelectric substance layer covers the vibrating plate in a view in the second direction.

With such a structure, since at least one of the first conductive layer, the second conductive layer, and the piezoelectric substance layer covers the vibrating plate in a view in the second direction, the over-etching of the vibrating plate does not occur during the production process. Thus, the liquid droplet discharging head offers improved durability.

(2) In a liquid droplet discharging head according to the above aspect of the invention, regarding two arbitrary areas of the first area surface that are formed adjacent to each other, the piezoelectric substance layer may not be formed at an area including at least a part of an area between one of the two areas and the other in a view in the second direction.

With such a structure, the piezoelectric substance layer is less likely to obstruct the deformation of the vibrating plate.

(3) In a liquid droplet discharging head according to the above aspect of the invention, an area where the piezoelectric substance layer is not formed may be located in a regional range between one end of the first area surface in the third direction and the other end of the first area surface in the third direction in a view in the second direction.

Therefore, the second conductive layer covers the regional part of the vibrating plate that is not covered by the piezoelectric substance layer.

(4) In a liquid droplet discharging head according to the above aspect of the invention, the second conductive layer may have extending portions that extend toward both sides in the third direction; and each of the extending portions may be formed at least at, in a view in the second direction, a part of an area between the first conductive layer that is formed at one area and the first conductive layer that is formed at another area adjacent to the one area.

With such a structure, it is easy to adjust the balance in rigidity in the third direction.

(5) In a liquid droplet discharging head according to the above aspect of the invention, the extending portions may extend beyond ends of the first area surface in the third direction in a view in the second direction.

Such a structure makes it easier to balance rigidity in the third direction.

(6) In a liquid droplet discharging head according to the above aspect of the invention, the extending portions may be formed at positions at which the extending portions do not overlap the first area surface at all in a view in the second direction.

With such a structure, the extending portions are less likely to obstruct the deformation of the vibrating plate.

(7) In a liquid droplet discharging head according to the above aspect of the invention, the area where the first conductive layer and the second conductive layer overlap each other may be formed symmetrically in a regional range between one end of the first area surface and the other end in the third direction with respect to the first direction, which is taken as an axis of symmetry, in a view in the second direction; and the extending portions may be symmetric with respect to the first direction taken as the axis of symmetry in the regional range between the one end of the first area surface and the other end in the third direction in a view in the second direction.

The above structure makes it possible to substantially balance rigidity in the third direction.

(8) In a liquid droplet discharging head according to the above aspect of the invention, the second conductive layer may be electrically connected to a common electrode; and at least a part of the extending portions may be electrically connected to the common electrode at an extension end.

With such a structure, a resistance value between the second conductive layer and the common electrode can be reduced.

(9) A liquid droplet discharging apparatus according to an aspect of the invention includes the liquid droplet discharging head having any of the above structures.

The liquid droplet discharging apparatus includes the liquid droplet discharging head that can avoid the over-etching of the vibrating plate during the production process, which offers improved durability.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a preferred embodiment of the present invention will now be explained in detail. The specific embodiment described below is not intended to limit the scope of the invention recited in the appended claims. Nor is it always necessary to combine all of features and/or constituent elements described below to offer the advantage of some aspects of the invention.

1. Liquid Droplet Discharging Head 1-1. Structure

The structure of a liquid droplet discharging head according to an exemplary embodiment of the invention is explained first while referring to the accompanying drawings.

In the description of the present embodiment of the invention, the term "on or over" is used as in, for example, "a certain element, matter, or the like (hereinafter referred to as "B") is formed on or over another element, matter, or the like (hereinafter referred to as "A"). In such description, the term "on or over" encompasses the meaning of a structure in which B is formed directly and physically immediately on A, a structure in which B is formed not directly on A but indirectly over A with still another element, matter, or the like being sandwiched or interposed between A and B, though not limited thereto. In like manner, the term "beneath or under" encompasses the meaning of a structure in which B is formed directly and physically immediately beneath A, a structure in which B is formed not directly beneath but indirectly under A with still another element, matter, or the like being sandwiched or interposed between A and B, though not limited thereto.

Figure 1:
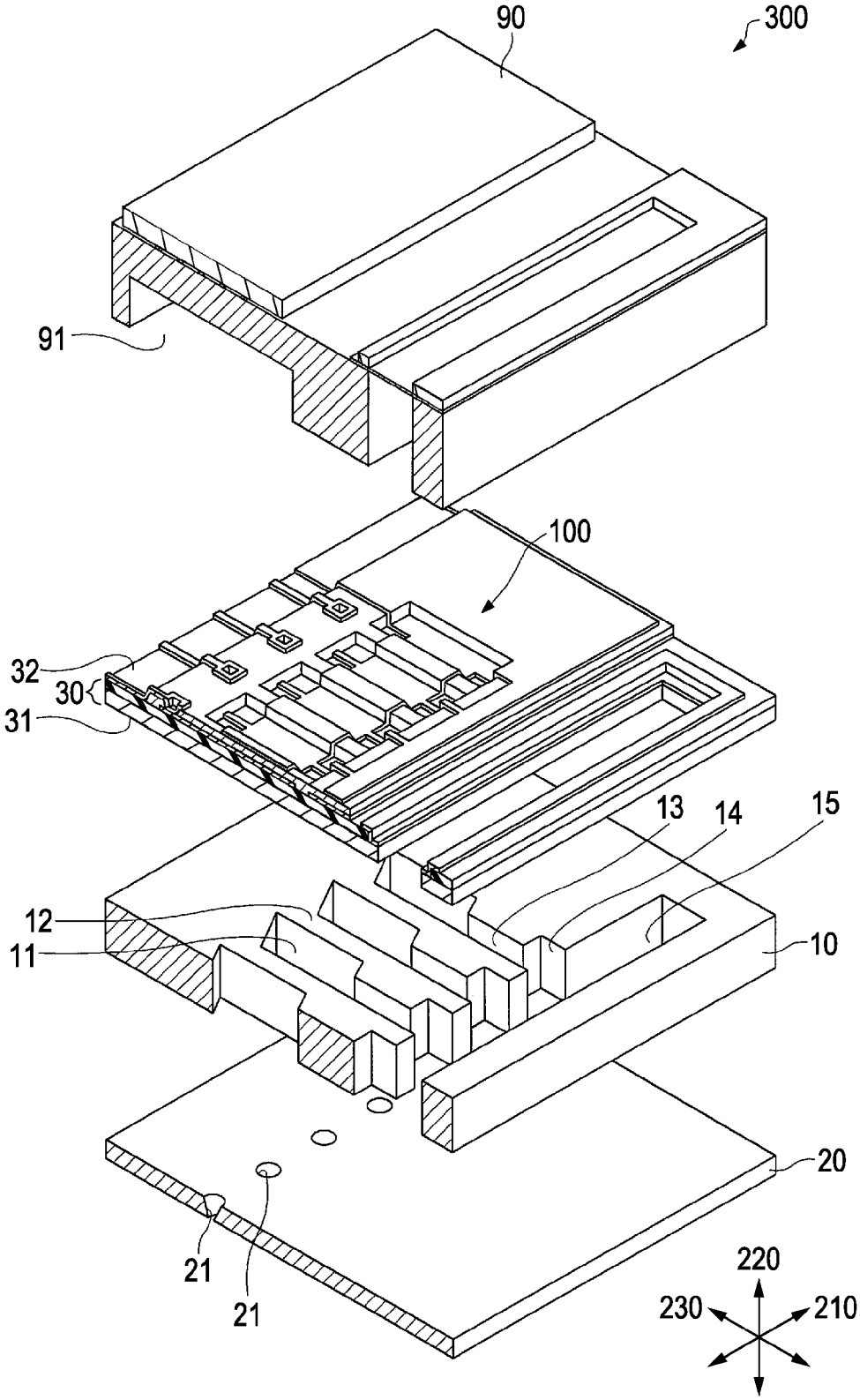
FIG. 1 is an exploded perspective view that schematically illustrates an example of the structure of a liquid droplet discharging head according to an exemplary embodiment of the invention.

FIG. 1 is an exploded perspective view that schematically illustrates an example of the structure of a liquid droplet discharging head according to an exemplary embodiment of the invention.

As illustrated in FIG. 1, a liquid droplet discharging head 300 includes a pressure chamber substrate 10, a nozzle plate 20, a diaphragm plate 30, and a sealing plate 90. A pressure chamber(s) 11 is formed in the pressure chamber substrate 10. The diaphragm plate 30, which can vibrate, is provided on or over the pressure chamber substrate 10. A piezoelectric element(s) 100 is provided on or over the diaphragm plate 30. The nozzle plate 20 is provided beneath or under the pressure chamber substrate 10. The sealing plate 90 covers the piezoelectric element 100 for sealing.

In the following description, the direction along which the pressure chambers 11 are formed adjacent to one another is defined as a first direction 210. The direction that is orthogonal to the first direction 210 and is normal to a first surface 31 of the diaphragm plate 30 is defined as a second direction 220. The direction orthogonal to both the first direction 210 and the second direction 220 is defined as a third direction 230. The terms "on or over" and "beneath or under" are used on the assumption that the second direction 220 is the vertical direction.

As illustrated in FIG. 1, the pressure chamber substrate 10 has the pressure chamber(s) 11, which is in communication with a nozzle hole(s) 21. The pressure chambers 11 are formed in the pressure chamber substrate 10 adjacent to one another in the first direction 210. The pressure chamber substrate 10 has a partition wall(s) 12. As illustrated in FIG. 1, the partition wall 12 is formed as a sidewall of the pressure chamber 11. The pressure chamber substrate 10 may have a reservoir 15. For example, the reservoir 15 is in communication with the pressure chamber 11 through a liquid supplying passage 13 and a communication passage 14. A through hole that is not illustrated in the drawings may be formed in communication with the reservoir 15. Liquid or the like may be supplied from the outside to the reservoir 15 through the through hole. Besides its ordinary meaning, the term "liquid" includes a fluid substance in which any of various kinds of functional materials is dissolved in a solvent or dispersed in a dispersion medium to have moderate viscosity and a fluid substance that contains metal flakes, though not limited thereto. The same applies hereinafter. With such a structure, it is possible to supply liquid or the like from the reservoir 15 to the pressure chamber 11 through the communication passage 14 and the liquid supplying passage 13 by supplying the liquid or the like to the reservoir 15. The shape of the pressure chamber 11 is not specifically limited. For example, in a view in the second direction 220, the shape of the pressure chamber 11 may be a parallelogram or a rectangle. The number of the pressure chambers 11 is not specifically limited. That is, the pressure chamber substrate 10 may have a single pressure chamber 11 or a plurality of pressure chambers 11. The material of the pressure chamber substrate 10 is also not specifically limited. For example, the pressure chamber substrate 10 may be made of single crystal silicon, nickel, stainless, stainless steel, glass ceramics, any of various resin materials, or the like.

As illustrated in FIG. 1, the nozzle plate 20 is provided beneath or under the pressure chamber substrate 10. The nozzle plate 20 is a plate member that has the nozzle hole(s) 21. The nozzle hole 21 is in communication with the pressure chamber 11. The shape of the nozzle hole 21 is not specifically limited as long as liquid or the like can be discharged in the form of droplets through the nozzle hole 21. Since the nozzle hole 21 is formed through the nozzle plate 20, the liquid droplet discharging head 300 can discharge liquid or the like that is retained in the pressure chamber 11 through the nozzle hole 21 toward, for example, a target under the nozzle plate 20. The number of the nozzle holes 21 is not specifically limited. That is, the nozzle plate 20 may have a single nozzle hole 21 or a plurality of nozzle holes 21. The material of the nozzle plate 20 is also not specifically limited. For example, the nozzle plate 20 may be made of single crystal silicon, nickel, stainless, stainless steel, glass ceramics, any of various resin materials, or the like.

As illustrated in FIG. 1, the diaphragm plate 30 is provided on or over the pressure chamber substrate 10. Therefore, the diaphragm plate 30 is disposed on or over the pressure chamber 11 and the partition wall 12. The diaphragm plate 30 is a plate member. The diaphragm plate 30 has the first surface 31 and a second surface 32, which is the opposite surface thereof. When the first surface 31 is defined as the front face of the diaphragm plate 30, the second surface 32 is defined as the reverse face thereof. The diaphragm plate 30 covers the pressure chamber substrate 10 at its first surface 31. The structure and material of the diaphragm plate 30 is not specifically limited. For example, as illustrated in FIG. 1, the diaphragm plate 30 may be formed as a laminated body that is made up of a plurality of films. For example, the diaphragm plate 30 may be formed as a laminated body that is made up of a plurality of films including an insulator film made of zirconium oxide, silicon oxide, or the like, a metal film made of nickel or the like, and a high polymer material film made of polyimide or the like. The diaphragm plate 30 functions as a vibrating portion. In other words, the diaphragm plate 30 can cause vibration by becoming deformed as a result of the stretching operation and shrinking operation of the piezoelectric element 100 described below. The vibrating operation of the diaphragm plate 30 causes a change in the capacity of the pressure chamber 11, which is formed beneath the diaphragm plate 30.

As illustrated in FIG. 1, the piezoelectric element 100 of the liquid droplet discharging head 300 according to the present embodiment of the invention is provided on or over the second surface 32 of the diaphragm plate 30. Next, the structure of the piezoelectric element 100 of the liquid droplet discharging head 300 according to the present embodiment of the invention will now be explained in detail.

Figure 2A:
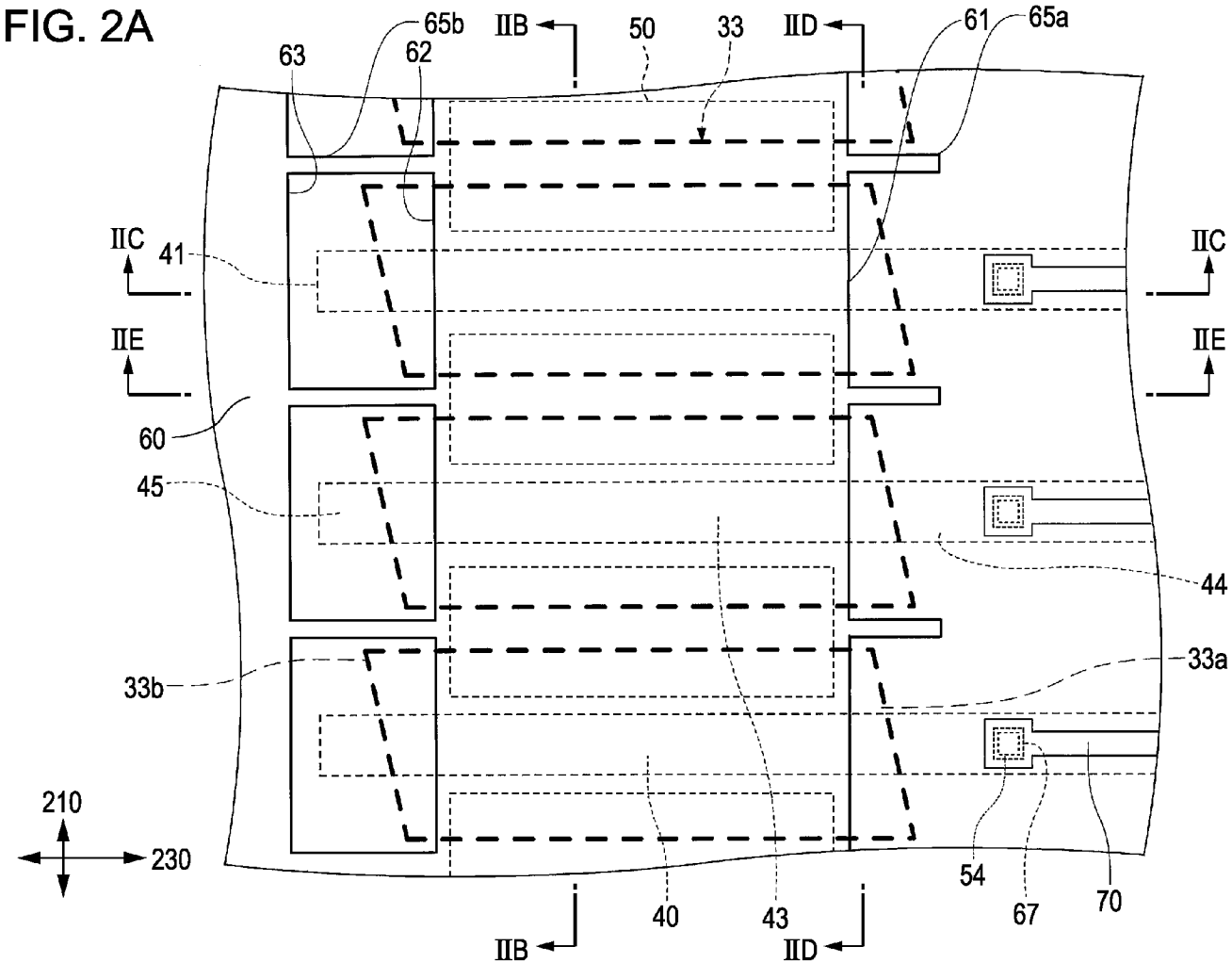
FIG. 2A is a plan view that schematically illustrates an example of the structure of the essential components of a liquid droplet discharging head according to an exemplary embodiment of the invention.
Figure 2B:
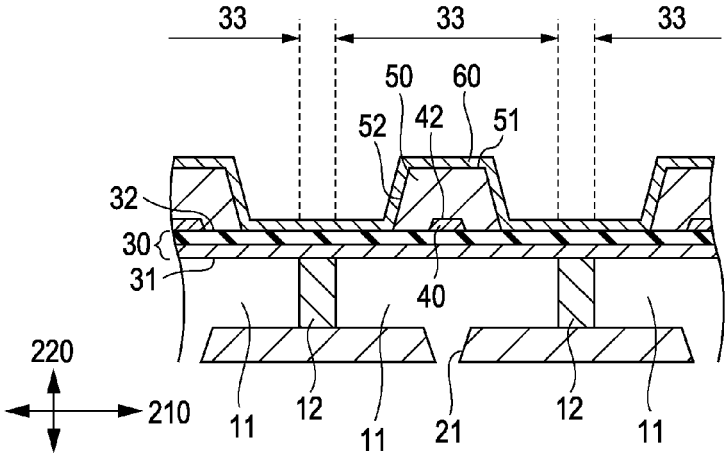
FIG. 2B is a sectional view taken along the line IIB-IIB of FIG. 2A.
Figure 2C:
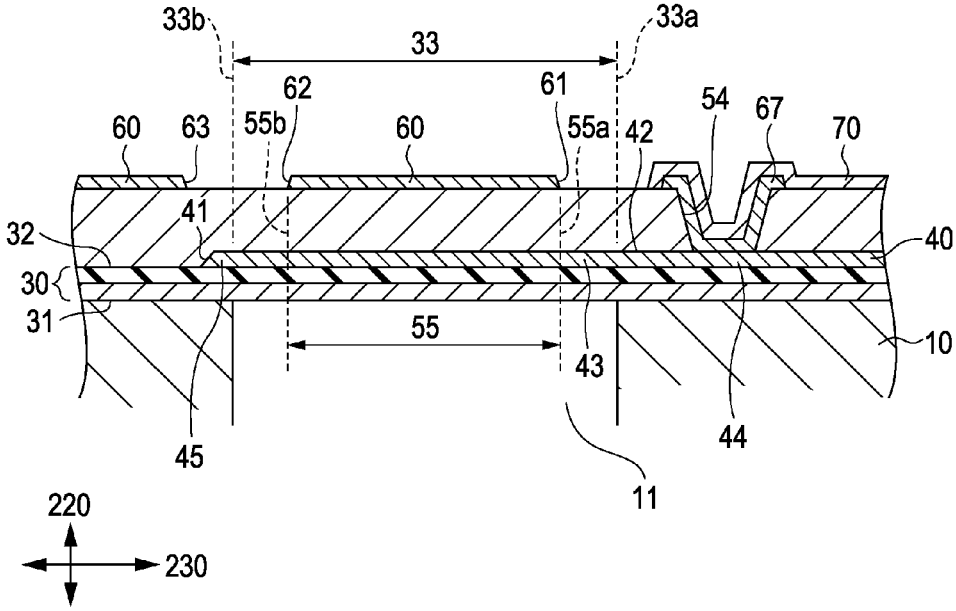
FIG. 2C is a sectional view taken along the line IIC-IIC of FIG. 2A.
Figure 2D:
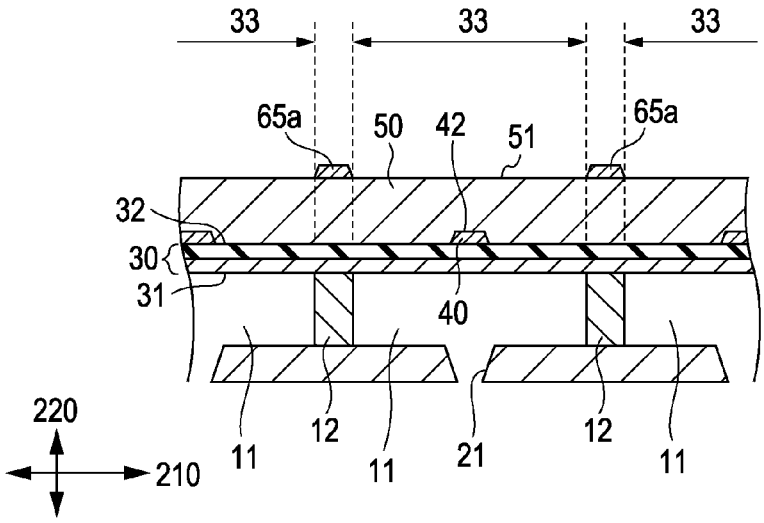
FIG. 2D is a sectional view taken along the line IID-IID of FIG. 2A.
Figure 2E:
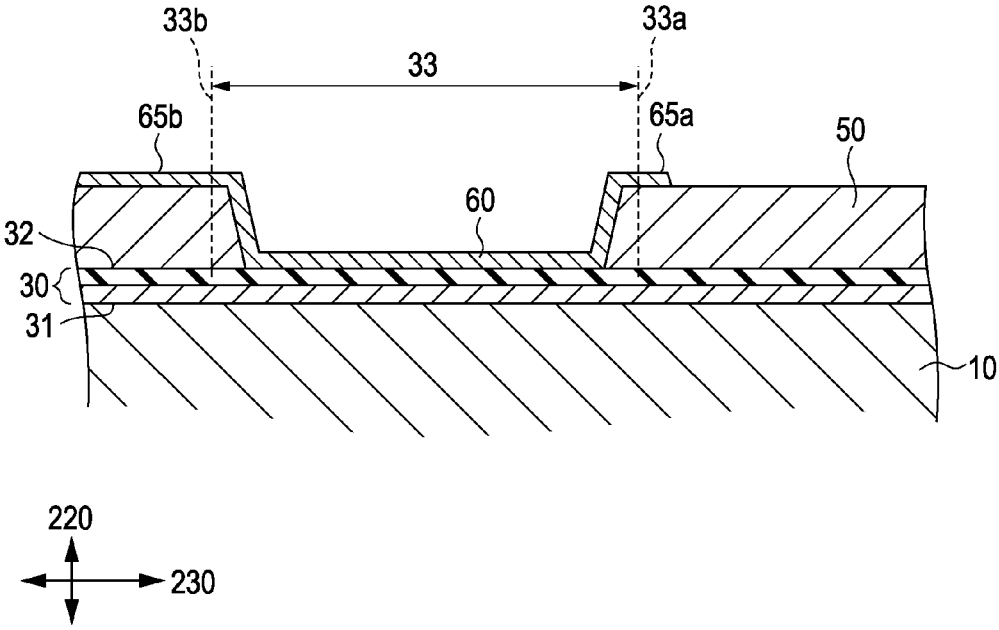
FIG. 2E is a sectional view taken along the line IIE-IIE of FIG. 2A.

FIG. 2A is a plan view that schematically illustrates an example of the structure of the pressure chamber substrate 10, the diaphragm plate 30, and the piezoelectric element 100 only, which constitute the essential components of the liquid droplet discharging head 300, while omitting the other components thereof for the purpose of explanation. FIG. 2B is a sectional view taken along the line IIB-IIB of FIG. 2A. FIG. 2C is a sectional view taken along the line IIC-IIC of FIG. 2A. FIG. 2D is a sectional view taken along the line IID-IID of FIG. 2A. FIG. 2E is a sectional view taken along the line IIE-IIE of FIG. 2A.

The structure of the piezoelectric element 100 is described in detail below. As illustrated in FIGS. 2A to 2E, the piezoelectric element 100 includes a first conductive layer 40, a piezoelectric substance layer 50, and a second conductive layer 60.

The diaphragm plate 30 has a first area surface 33 as a part of its first surface 31. As illustrated in FIGS. 2A and 2B, the first area surface 33 covers the pressure chamber 11 in a view in the second direction 220. As illustrated in FIGS. 2A and 2B, in the present embodiment of the invention, the first area surface 33 lies at the area of the pressure chamber 11 in a view in the second direction 220. The term "overlap", which does not necessarily mean that an element lies partially on or over another element, is used hereinafter. In addition, as illustrated in FIGS. 2A and 2B, the first area surface 33 is formed for each of the plurality of pressure chambers 11.

The first conductive layer 40 is formed at a plurality of areas (i.e., regions). The first conductive layer 40 partially covers the second surface 32 of the diaphragm plate 30. The first conductive layer 40 covers the second surface 32 inside each area that overlaps the first area surface 33 in the first direction 210. The first conductive layer 40 extends from the area that overlaps the first area surface 33 to an area that is located outside the area overlapping the first area surface 33 in the third direction 230 to cover the second surface 32 thereat.

As illustrated in FIGS. 2A and 2C, the first conductive layer 40 according to the present embodiment of the invention has an end face 41 at, for example, the area that is located outside the area overlapping the first area surface 33 in a view in the second direction 220. The end face 41 is formed at one side in the third direction 230. The end face 41 is a side face of the first conductive layer 40 in the third direction 230. The end face 41 may be inclined as a tapered surface. As illustrated in FIGS. 2A and 2B, the first conductive layer 40 according to the present embodiment of the invention has a side portion at each of both sides in the first direction 210 inside the area overlapping the first area surface 33 in a view in the second direction 220. As illustrated in FIGS. 2A and 2C, the first conductive layer 40 according to the present embodiment of the invention further has an upper surface 42.

The first conductive layer 40 is made up of, for example, a first conductive portion 43, a second conductive portion 44, and a third conductive portion 45. As illustrated in FIGS. 2A and 2C, as a part of the first conductive layer 40, the first conductive portion 43 is formed inside the area overlapping the first area surface 33 in a view in the second direction 220. When one short side of the area overlapping the first area surface 33 is defined as a first side 33*a*, the first conductive layer 40 extends from the area overlapping the first area surface 33 to an area that is located outside the area overlapping the first area surface 33 across the first side 33*a*. The part of the first conductive layer 40 that is located outside the area overlapping the first area surface 33 is formed as the second conductive portion 44. That is, the first side 33*a* is the border between the area of the first conductive portion 43 and the area of the second conductive portion 44. On the other hand, when the other short side of the area overlapping the first area surface 33 is defined as a second side 33*b*, the first conductive layer 40 extends from the area overlapping the first area surface 33 to another area that is located outside the area overlapping the first area surface 33 across the second side 33*b*. The part of the first conductive layer 40 that is located outside the area overlapping the first area surface 33 is formed as the third conductive portion 45. That is, the second side 33*b* is the border between the area of the first conductive portion 43 and the area of the third conductive portion 45. Therefore, in a case where the end face 41 is formed at the area that is located outside the area overlapping the first area surface 33 in a view in the second direction 220, the end face 41 constitutes an end of the third conductive portion 45. In a case where the end face 41 is formed inside the area overlapping the first area surface 33 in a view in the second direction 220, the end face 41 constitutes an end of the first conductive portion 43. In the layer structure of the piezoelectric element 100, the first conductive layer 40 is formed as a lower electrode.

The structure and material of the first conductive layer 40 is not specifically limited. For example, the first conductive layer 40 may be formed as a monolayer. Alternatively, the first conductive layer 40 may be formed as a laminated body that is made up of a plurality of films. For example, the first conductive layer 40 may include a layer that is made of metal including any of platinum (Pt), iridium (Ir), gold (Au), or the like, a layer that is made of conductive oxide such as lanthanum nickel oxide ($LaNiO_3$), strontium ruthenium oxide ($SrRuO_3$), or the like.

The piezoelectric substance layer 50 is formed in such a manner that it covers the first conductive layer 40 at least inside each area that overlaps the first area surface 33 in a view in the second direction 220. As illustrated in FIGS. 2A and 2B, the piezoelectric substance layer 50 according to the present embodiment of the invention has a side portion at each of both sides in the first direction 210 inside the area overlapping the first area surface 33 in a view in the second direction 220. Specifically, the piezoelectric substance layer 50 has a width that is larger than the width of the first conductive layer 40 but smaller than the width of the first area surface 33 in the first direction 210. As illustrated in FIGS. 2A and 2C, the piezoelectric substance layer 50 extends to areas that are located outside the area overlapping the first area surface 33 in the third direction 230 and, in a view in the second direction 220, covers the second conductive portion 44 and the third conductive portion 45 of the first conductive layer 40 thereat. The shape of the piezoelectric substance layer 50 is not specifically limited. For example, as illustrated in FIGS. 2A and 2B, the piezoelectric substance layer 50 may have an upper surface 51 over the first conductive layer 40 and side surfaces 52 that are tapered and continuous from the upper surface 51.

As illustrated in FIGS. 2A and 2B, when attention is drawn to two arbitrary first surface areas (i.e., areas of the first area surface) 33 that are formed adjacent to each other, the piezoelectric substance layer 50 may not be formed at an area including at least a part of an area between one of the two surface areas and the other in a view in the second direction 220. The area where the piezoelectric substance layer 50 is not formed may be located in a regional range between one end of the first area surface 33 in the third direction 230 and the other end of the first area surface 33 in the third direction 230 in a view in the second direction 220.

The piezoelectric substance layer 50 is made of a polycrystalline substance that has piezoelectric characteristics. The piezoelectric substance layer 50 can vibrate when a voltage is applied thereto in the piezoelectric element 100. The structure and material of the piezoelectric substance layer 50 is not specifically limited as long as it has piezoelectric characteristics. Any known piezoelectric material can be used to form the piezoelectric substance layer 50. For example, lead zirconate titanate ($Pb(Zr,Ti)O_3$), sodium bismuth titanate ($(Bi,Na)TiO_3$), or the like can be used as the material of the piezoelectric substance layer 50.

As illustrated in FIGS. 2A and 2C, the piezoelectric substance layer 50 may have an opening 54 that is formed through the piezoelectric substance layer 50 over the second conductive portion 44 of the first conductive layer 40 to expose a part of the second conductive portion 44 therethrough. The position of the opening 54 is not specifically limited as long as it is located over the second conductive portion 44 of the first conductive layer 40 away from the second conductive layer 60, which will be explained later. The shape of the opening 54 is not specifically limited as long as it can expose a part of the second conductive portion 44 of the first conductive layer 40.

As a requisite regarding the position of the opening 54, it is necessary that the opening 54 should be located outside the first area surface 33 for the purpose of ensuring diaphragm symmetry. The distance from the first area surface 33 is determined on the basis of a tolerable wiring resistance value. Unlike the first conductive portion 43 and the second conductive portion 44, a wiring layer 70 is not a constituent element of the diaphragm plate 30. Therefore, there is not any constraint on increasing the film thickness thereof for lowering the resistance value. If it is necessary to obtain a greater reduction in the resistance value, it is preferable to form the opening 54 at a position as close to the first area surface 33 as practicable in manufacturing.

In a view in the second direction 220, the second conductive layer 60 covers at least a part of the piezoelectric substance layer 50 in such a manner that the second conductive layer 60 lies over (i.e., overlaps) the first conductive layer 40 in the first direction 210 and lies over a part of the first conductive layer 40 in the third direction 230 at least inside each area that overlaps the first area surface 33. Moreover, in a view in the second direction 220, the second conductive layer 60 lies over the first conductive layer 40 formed at a plurality of areas.

As illustrated in FIGS. 2A and 2B, in a view in the second direction 220, the second conductive layer 60 according to the present embodiment of the invention covers the piezoelectric substance layer 50 inside the area overlapping the first area surface 33 in the first direction 210. As illustrated in FIGS. 2A and 2C, in a view in the second direction 220, the second conductive layer 60 according to the present embodiment of the invention has two end faces 61 and 62 inside the area overlapping the first area surface 33 in the third direction 230. The end faces 61 and 62 are formed at positions at which they overlap the upper surface 42 of the first conductive layer 40 in a view in the second direction 220. The end faces 61 and 62 are surfaces at ends of the second conductive layer 60 in the third direction 230 that are formed during the patterning of a conductive layer into the second conductive layer 60 inside the area overlapping the first area surface 33 in a view in the second direction 220. The end face 62 is an end surface that is formed at the side where the end face 41 of the first conductive layer 40 is formed. The end face 61 is an end surface that is formed at the side where the opening 54 is formed. In the present embodiment of the invention, as illustrated in FIGS. 2A and 2C, the size of the second conductive layer 60 in the third direction 230 is smaller than that of the first conductive portion 43 of the first conductive layer 40 in the third direction 230 inside the area overlapping the first area surface 33 in a view in the second direction 220.

As illustrated in FIGS. 2A and 2B, the second conductive layer 60 may extend in the first direction 210 as a continuous layer that covers the piezoelectric substance layer 50 at each of a plurality of areas. In addition, as illustrated in FIGS. 2A and 2B, the second conductive layer 60 may cover the upper surface 51 and the side surfaces 52 of each regional part of the piezoelectric substance layer 50 continuously.

As illustrated in FIGS. 2A and 2C, the piezoelectric element 100 may have open areas 63 where the second conductive layer 60 is not formed. The end face 62 may be formed as a part of each of the open areas 63.

As illustrated in FIGS. 2A and 2C, the second conductive layer 60 according to the present embodiment of the invention is formed in such a manner that, inside the area overlapping the first area surface 33, the end faces 61 and 62 overlap the upper surface 42 of the first conductive layer 40 in a view in the second direction 220. Because of the layout explained above, a regional part of the piezoelectric substance layer 50 inside the area overlapping the first area surface 33 in a view in the second direction 220 is sandwiched between the first conductive portion 43 of the first conductive layer 40 and the second conductive layer 60. The regional part of the piezoelectric substance layer 50 that is sandwiched between the first conductive layer 40 and the second conductive layer 60 is defined as a driving area 55. As illustrated in FIGS. 2A and 2C, the position of the end face 61 of the second conductive layer 60 determines the position of one end 55*a* of the driving area 55 in the third direction 230. The position of the end face 62 of the second conductive layer 60 determines the position of the other end 55*b* of the driving area 55 in the third direction 230. Therefore, the driving area 55 is formed over the upper surface 42 of the first conductive portion 43 of the first conductive layer 40. In other words, the driving area 55 is not formed over the end face 41 of the first conductive layer 40. As illustrated in FIGS. 2A and 2C, the second conductive layer 60 may be formed in such a manner that it does not overlap the first side 33*a* of the first area surface 33 at all in a view in the second direction 220.

At least one of the first conductive layer 40, the second conductive layer 60, and the piezoelectric substance layer 50 covers the diaphragm plate 30 in a view in the second direction 220. In the present embodiment of the invention, as illustrated in FIGS. 2A and 2C, the piezoelectric substance layer 50 is formed at the open areas 63 where the second conductive layer 60 is not formed in a view in the second direction 220.

The second conductive layer 60 may have extending portions 65*a* and 65*b*. The extending portion 65*a* extends toward one side in the third direction 230. The extending portion 65*b* extends toward the other side in the third direction 230. Each of the extending portions 65*a* and 65*b* is formed at least at, in a view in the second direction 220, a part of an area between the first conductive layer 40 that is formed at one area and the first conductive layer 40 that is formed at another area adjacent to the one area.

As illustrated in FIGS. 2A and 2E, in a view in the second direction 220, the extending portions 65*a* and 65*b* according to the present embodiment of the invention extend beyond the respective ends of the first area surface 33 in the third direction 230 (i.e., the first side 33*a* and the second side 33*b*). In addition, as illustrated in FIGS. 2A and 2D, the extending portions 65*a* and 65*b* are formed at positions at which they do not overlap the first area surface 33 at all in a view in the second direction 220.

In the present embodiment of the invention, as illustrated in FIGS. 2A and 2C, the area where the first conductive layer 40 and the second conductive layer 60 overlap each other, that is, the area where the driving part 55 of the piezoelectric element 100 is formed, is formed symmetrically in a regional range between one end of the first area surface 33 and the other end in the third direction 230 with respect to the first direction 210, which is taken as the axis of symmetry, in a view in the second direction 220. In addition, the extending portions 65*a* and 65*b* are symmetric with respect to the first direction 210 taken as the axis of symmetry in the regional range between the one end of the first area surface 33 and the other end in the third direction 230 in a view in the second direction 220.

The second conductive layer 60 is electrically connected to a common electrode (not shown). At least a part of the extending portions 65*a* and/or 65*b* may be electrically connected to the common electrode at the end of extension. In the example illustrated in FIGS. 2A and 2E, the extending portion 65*b* formed at a plurality of areas, which may be hereinafter referred to as the plurality of extending portions, is electrically connected to the common electrode at each of the extension ends of the areas.

Figure 2F:
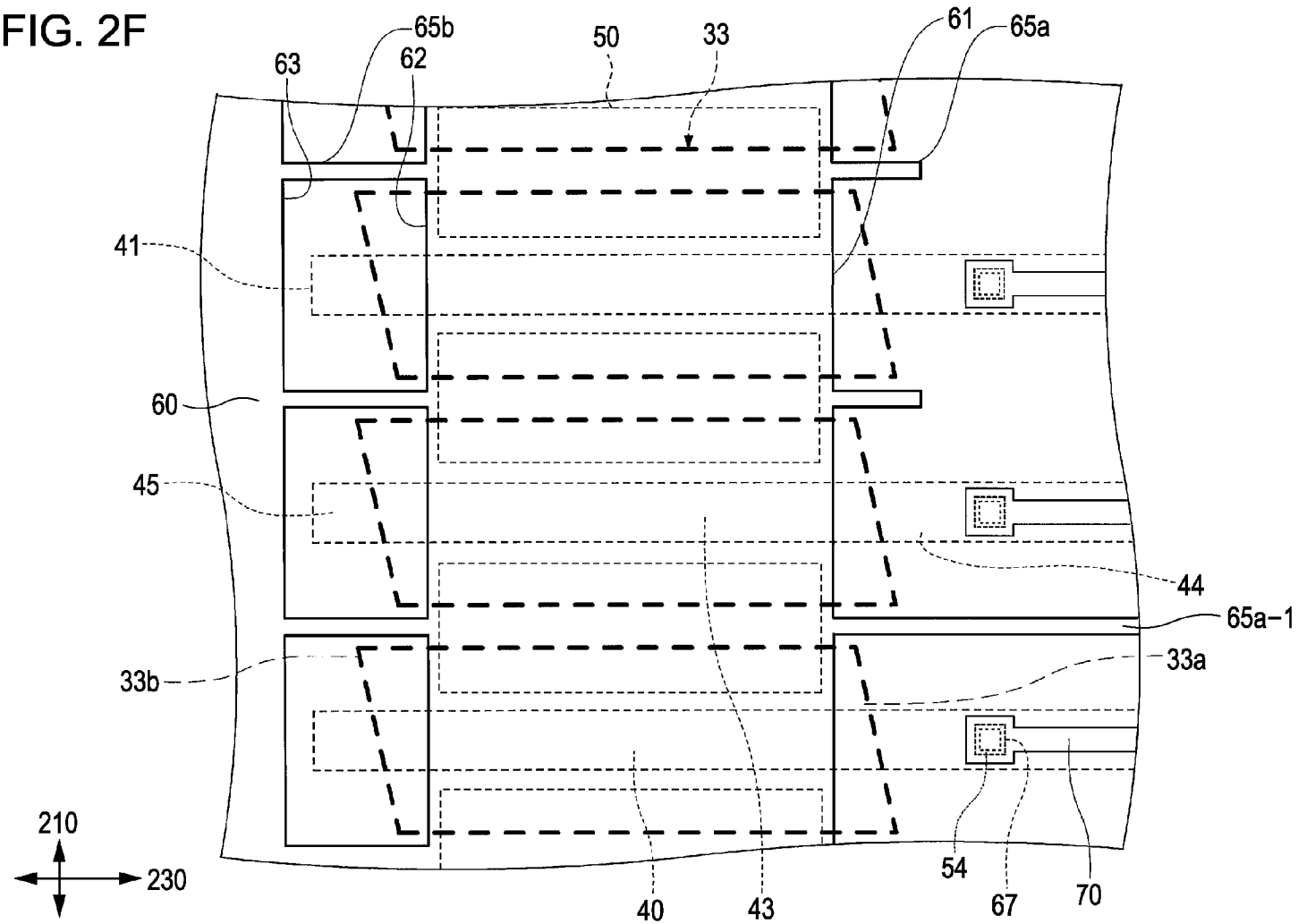
FIG. 2F is a plan view that schematically illustrates the structure of the essential components of a liquid droplet discharging head according to a variation example of the embodiment of the invention.

FIG. 2F is a plan view that schematically illustrates the structure of the essential components of a liquid droplet discharging head according to a variation example of the embodiment of the invention. In the example illustrated in FIG. 2F, an extending portion(s) 65*a*–1, which is a part of the plurality of extending portions 65*a*, and the plurality of extending portions 65*b* are electrically connected to the common electrode at the ends of extension.

The structure and material of the second conductive layer 60 is not specifically limited. For example, the second conductive layer 60 may be formed as a monolayer. Alternatively, the second conductive layer 60 may be formed as a laminated body that is made up of a plurality of films. The second conductive layer 60 is a layer that has electric conductivity. In the layer structure of the piezoelectric element 100, the second conductive layer 60 is formed as an upper electrode. For example, the second conductive layer 60 may include a layer that is made of metal including any of platinum (Pt), iridium (Ir), gold (Au), or the like. Though not illustrated in the drawings, the second conductive layer 60 may be connected to the common electrode (not shown) through wiring. Alternatively, for example, the second conductive layer 60 may extend directly from the common electrode for connection to the common electrode. The second conductive layer 60 can cover a part of the piezoelectric substance layer 50 including the regional part at the driving area 55 completely in the first direction 210. With such a structure, it is possible to protect the regional part of the piezoelectric substance layer 50 at the driving area 55 from the effects of ambient conditions including but not limited to moisture in the air.

As illustrated in FIGS. 2A and 2C, a third conductive layer 67 may be additionally formed in such a manner that it covers at least the opening 54. Though not illustrated in the drawings, the third conductive layer 67 may cover the second conductive portion 44 of the first conductive layer 40 at least at the opening 54. The structure and material of the third conductive layer 67 is not specifically limited. The third conductive layer 67 may be the same as the second conductive layer 60 as long as it is formed as a layer that has electric conductivity. The third conductive layer 67 formed as explained above makes it possible to protect the surface of the second conductive portion 44 of the first conductive layer 40 at the opening 54 during the production process. The third conductive layer 67 will be explained in detail later in Section 1-2: Manufacturing Method. Since the third conductive layer 67 is not an indispensable component of the piezoelectric element 100 according to the present embodiment of the invention, though not illustrated in the drawings, the third conductive layer 67 may not be formed on the first conductive layer 40 at the opening 54.

As illustrated in FIGS. 2A and 2C, a fourth conductive layer 70 may be formed on the third conductive layer 67 for electrical connection thereto. That is, the fourth conductive layer 70 is electrically connected to the first conductive portion 43 through the second conductive portion 44. The fourth conductive layer 70 may cover at least the opening 54. The shape of the fourth conductive layer 70 is not specifically limited as long as at least a part thereof is formed inside the opening 54. The structure and material of the fourth conductive layer 70 is not specifically limited. For example, the fourth conductive layer 70 may be formed as a monolayer. Alternatively, the fourth conductive layer 70 may be formed as a laminated body that is made up of a plurality of films. The fourth conductive layer 70 is a layer that has electric conductivity. In the layer structure of the piezoelectric element 100, the fourth conductive layer 70 is formed as a lead wire connected to the lower electrode. For example, the fourth conductive layer 70 may be a layer that is made of metal including any of gold (Au), nickel-chromium alloy (Ni—Cr), platinum (Pt), iridium (Ir), copper (Cu), nickel (Ni), or the like. Though not illustrated in the drawings, the fourth conductive layer 70 may be electrically connected to an external driving circuit. With such a structure, it is possible to electrically connect the external driving circuit to the first conductive layer 40 through the fourth conductive layer 70. The fourth conductive layer 70 should preferably be made of the same material as that of the common electrode. This is because it is desirable that the junction surface of the fourth conductive layer 70 for electrical connection to the external driving circuit by using a wire bonding method, an FPC soldering method, or the like be made of the same metal as that of the common electrode for connection using the method.

The liquid droplet discharging head 300 according to the present embodiment of the invention may include the sealing plate 90, which can seal the piezoelectric element 100 as illustrated in FIG. 1. The sealing plate 90 has a space 91 in which the piezoelectric element 100 can be enclosed for sealing. The sealing space 91 may be any space that is wide enough so as not to obstruct the vibration of the piezoelectric element 100. The structure and material of the sealing plate 90 is not specifically limited. For example, the sealing plate 90 may be made of single crystal silicon, nickel, stainless, stainless steel, glass ceramics, or the like. Though not illustrated in the drawings, the liquid droplet discharging head 300 may further include a case member in which the components described above can be encased. For example, the case member is made of any of various resin materials, any of various metal materials, or the like.

The liquid droplet discharging head 300 according to the present embodiment of the invention has any of the above structures.

The liquid droplet discharging head 300 according to the present embodiment of the invention has, for example, the following features.

In the structure of the liquid droplet discharging head 300 according to the present embodiment of the invention, at least one of the first conductive layer 40, the second conductive layer 60, and the piezoelectric substance layer 50 covers the diaphragm plate 30 in a view in the second direction 220. Therefore, the over-etching of the diaphragm plate 30 does not occur during the production process. Thus, the liquid droplet discharging head 300 offers improved durability.

Regarding two arbitrary areas of the first area surface 33 that are formed adjacent to each other, the piezoelectric substance layer 50 is not formed at an area including at least a part of an area between one of the two surface areas and the other in a view in the second direction 220. Such a structure is advantageous in that the piezoelectric substance layer 50 is less likely to obstruct the deformation of the diaphragm plate 30.

The area where the piezoelectric substance layer 50 is not formed is located in a regional range between one end of the first area surface 33 in the third direction 230 and the other end of the first area surface 33 in the third direction 230 in a view in the second direction 220. Therefore, the second conductive layer 60 covers the regional part of the diaphragm plate 30 that is not covered by the piezoelectric substance layer 50.

The second conductive layer 60 has the extending portion 65*a* that extends toward one side in the third direction 230 and the extending portion 65*b* that extends toward the other side in the third direction 230. Each of the extending portions 65*a* and 65*b* is formed at least at, in a view in the second direction 220, a part of an area between the first conductive layer 40 that is formed at one area and the first conductive layer 40 that is formed at another area adjacent to the one area. With such a structure, it is easy to adjust the balance in rigidity in the third direction 230.

In a view in the second direction 220, the extending portions 65*a* and 65*b* extend beyond the respective ends of the first area surface 33 in the third direction 230, which makes it easier to balance rigidity in the third direction 230. Since the extending portions 65*a* and 65*b* are formed at positions at which they do not overlap the first area surface 33 at all in a view in the second direction 220, they are less likely to obstruct the deformation of the diaphragm plate 30.

The area where the first conductive layer 40 and the second conductive layer 60 overlap each other is formed symmetrically in a regional range between one end of the first area surface 33 and the other end in the third direction 230 with respect to the first direction 210, which is taken as the axis of symmetry, in a view in the second direction 220. In addition, the extending portions 65*a* and 65*b* are symmetric with respect to the first direction 210 taken as the axis of symmetry in the regional range between the one end of the first area surface 33 and the other end in the third direction 230 in a view in the second direction 220. The above structure makes it possible to substantially balance rigidity in the third direction 230.

The second conductive layer 60 is electrically connected to the common electrode. At least a part of the extending portions 65*a* and/or 65*b* is electrically connected to the common electrode at the end of extension. Therefore, a resistance value between the second conductive layer 60 and the common electrode can be reduced.

In the above description of an exemplary embodiment of the invention, an ink-jet recording head that discharges ink droplets is taken as an example. However, the invention can be applied to various kinds of liquid droplet discharging heads that use a piezoelectric element(s) and to various kinds of liquid droplet discharging apparatuses. Liquid droplet discharging heads to which the invention is applicable encompass a wide variety of heads; specifically, they include without any limitation thereto: a variety of recording heads that are used in an image recording apparatus such as a printer or the like, a color material ejection head that is used in the production of color filters for a liquid crystal display device or the like, an electrode material ejection head that is used for the electrode formation of an organic EL display device, a surface/plane emission display device (FED), or the like, and a living organic material ejection head that is used for production of biochips.

1-2. Manufacturing Method

With reference to the accompanying drawings, a method for manufacturing the liquid droplet discharging head 300 according to the present embodiment of the invention will now be explained.

FIGS. 3 to 9 are sectional views that schematically illustrate an example of a method for manufacturing the liquid droplet discharging head 300 according to the present embodiment of the invention.

The method for manufacturing a liquid droplet discharging head according to the present embodiment of the invention differs depending on whether, for example, single crystal silicon is used as the material of the pressure chamber substrate 10 and the nozzle plate 20 or, for example, stainless is used as the material thereof. In the following description of an example of the method for manufacturing a liquid droplet discharging head, it is assumed that single crystal silicon is used as the material thereof. Note that the manufacturing method is not limited to the example described below. For example, if nickel, stainless steel, stainless, or the like is used as the material, a step of known electroforming may be included therein. The sequential order of manufacturing steps described below is a mere example.

Figure 3A:
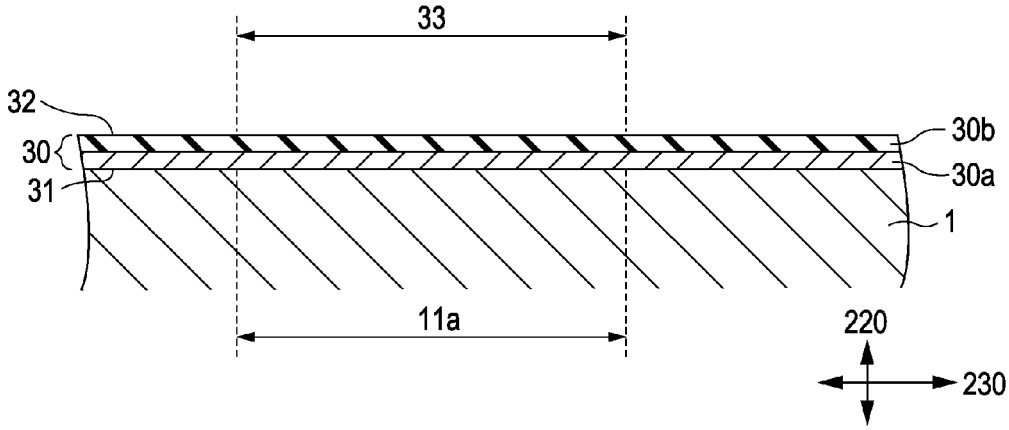
FIG. 3A is a sectional view that schematically illustrates a process in a method for manufacturing a liquid droplet discharging head according to an exemplary embodiment of the invention.

As a first step, as illustrated in FIG. 3A, the diaphragm plate 30 is formed on a substrate 1 that is made of single crystal silicon. As illustrated in FIG. 3A, a region of the substrate 1 at which the pressure chamber 11 will be formed later is defined as region 11*a*. A known technique for film deposition is used to form the diaphragm plate 30. As illustrated in FIG. 3A, for example, an elastic layer 30*a*, which constitutes an elastic plate, is formed on the substrate 1 by using a sputtering method or the like. Thereafter, an insulating layer 30*b* is formed on the elastic layer 30*a* by using a sputtering method or the like. An example of the material of the elastic layer 30*a* is zirconium oxide. An example of the material of the insulating layer 30*b* is silicon oxide. The substrate-side surface of the diaphragm plate 30, which lies on the substrate 1, is defined as the first surface 31. The reverse surface is defined as the second surface 32. An area of the first surface 31 that overlaps (i.e., is located at) the region 11*a* in a view in the second direction 220 is defined as the first area surface 33.

Figure 3B:
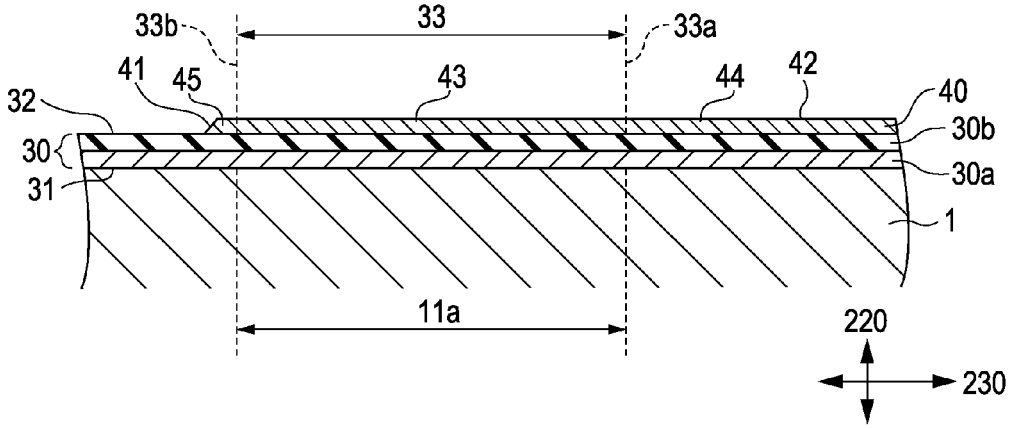
FIG. 3B is a sectional view that illustrates a process in the manufacturing method according to the exemplary embodiment of the invention.

After the forming of the diaphragm plate 30 on the substrate 1, a conductive layer is formed on the second surface 32 of the diaphragm plate 30, followed by the patterning of the conductive layer to form the first conductive layer 40 by using an etching method as illustrated in FIG. 3B. The first conductive layer 40 has the following pattern. In a view in the second direction 220, the first conductive layer 40 covers the second surface 32 of the diaphragm plate 30 inside an area that overlaps the region 11*a* in the first direction 210. In a view in the second direction 220, the first conductive layer 40 extends from the area that overlaps the region 11*a* to an area that is located outside the area overlapping the region 11*a* at least one side in the third direction 230 to cover the second surface 32 of the diaphragm plate 30 thereat.

When the conductive layer is patterned to form the first conductive layer 40, as illustrated in FIG. 3B, an end face that is inclined as a tapered surface is formed at one side in the third direction 230. The end face 41 is formed in this way. The upper surface 42 is formed concurrently during the process of formation of the first conductive layer 40. The end face 41 may be formed at the area that is located outside the area overlapping the first area surface 33 in a view in the second direction 220. Though not illustrated in the drawings, the end face 41 may be formed inside the area overlapping the first area surface 33 in a view in the second direction 220.

As a part of the first conductive layer 40, the first conductive portion 43 may be formed inside the area overlapping the first area surface 33 in a view in the second direction 220. When one short side of the area overlapping the first area surface 33 is defined as the first side 33*a*, the first conductive layer 40 may extend from the area overlapping the first area surface 33 to an area that is located outside the area overlapping the first area surface 33 across the first side 33*a*. The part of the first conductive layer 40 that is located outside the area overlapping the first area surface 33 may be formed as the second conductive portion 44, which borders on the first conductive portion 43 at the first side 33*a*. If the end face 41 is formed at another area that is located outside the area overlapping the first area surface 33 in a view in the second direction 220, the first conductive layer 40 extends from the area overlapping the first area surface 33 to the outside area mentioned above across the second side 33*b*. The part of the first conductive layer 40 that is located outside the area overlapping the first area surface 33 may be formed as the third conductive portion 45, which borders on the first conductive portion 43 at the second side 33*b*.

The detailed structure of the first conductive layer 40 is not described here because it is explained earlier. A known technique for film deposition can be used to form the first conductive layer 40. For example, the first conductive layer 40 can be formed as follows. Platinum, iridium, and the like are deposited by using a sputtering method or the like to form a conductive layer (not shown). The conductive layer is etched into the first conductive layer 40 having a predetermined pattern.

Figure 3C:
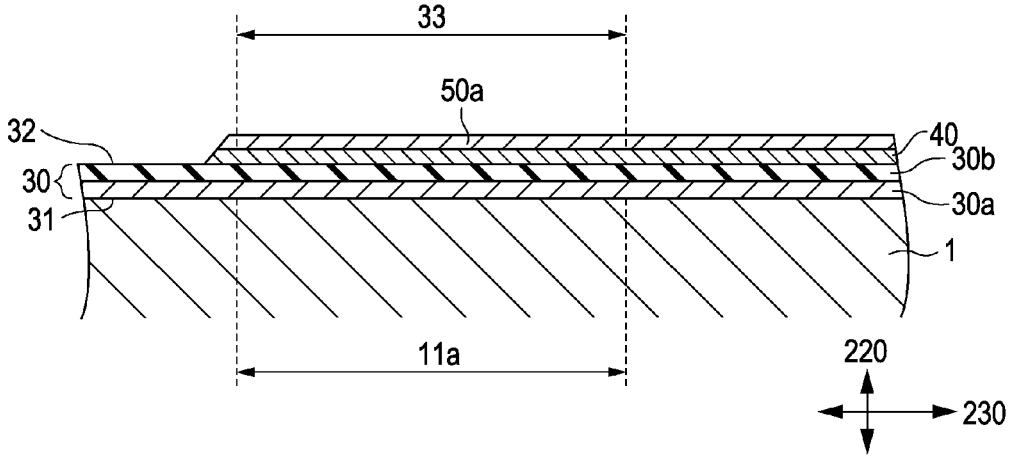
FIG. 3C is a sectional view that illustrates a process in the manufacturing method according to the exemplary embodiment of the invention.

As illustrated in FIG. 3C, before the patterning of the conductive layer to form the first conductive layer 40 by etching, an etching protection film 50*a* may be formed on the conductive layer. The etching protection film 50*a* is a piezoelectric film that is made of the same piezoelectric material as that of the piezoelectric substance layer 50, which will be formed as explained later. The etching protection film 50*a* may be formed at an area that includes at least an area where the first conductive layer 40 having a desired pattern will be formed. If the etching protection film 50*a* is formed, it is possible to protect the surface of the first conductive layer 40 from chemical damage due to the use of an etchant during the etching process.

Figure 4A:
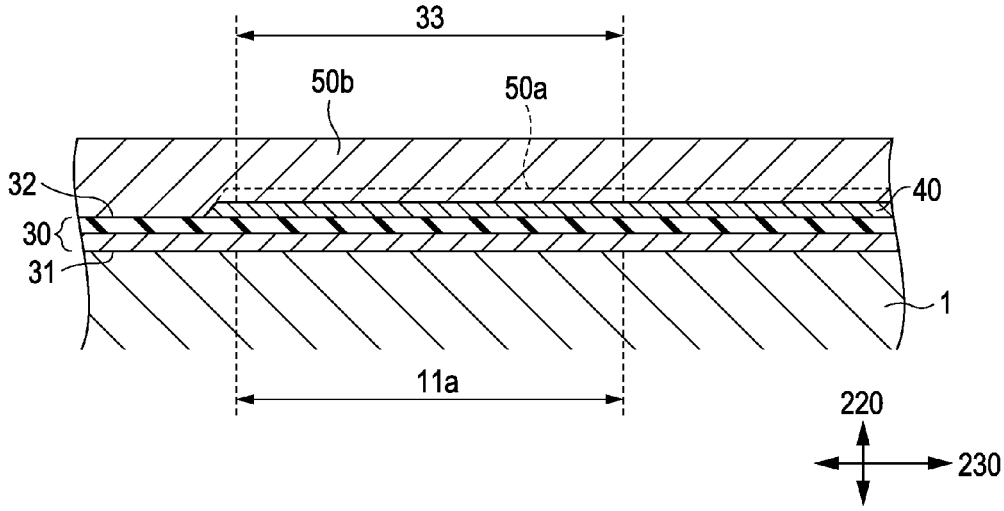
FIG. 4A is a sectional view that illustrates a process in the manufacturing method according to the exemplary embodiment of the invention.

Next, as illustrated in FIG. 4A, a piezoelectric substance layer 50*b* is formed in such a manner that it covers the first conductive layer 40. Then, the piezoelectric substance layer 50*b* is patterned to form the piezoelectric substance layer 50. The detail of the patterning will be explained later. A known technique for film deposition can be used to form the piezoelectric substance layer 50*b*. For example, a known piezoelectric material is applied as a precursor to the second surface 32 of the diaphragm plate 30. Then, the precursor is heat-treated to form the piezoelectric substance layer 50*b*. Any kind of precursor can be used as long as it can be polarized after baking by heat treatment to exhibit piezoelectric characteristics. For example, a precursor such as lead zirconate titanate can be used. If the etching protection film 50*a* was formed in the preceding step, the piezoelectric substance layer 50*b* and the etching protection film 50*a* can turn into a single layer during the baking process because the etching protection film 50*a* is made of the same piezoelectric material as that of the piezoelectric substance layer 50*b* (piezoelectric substance layer 50).

Figure 4B:
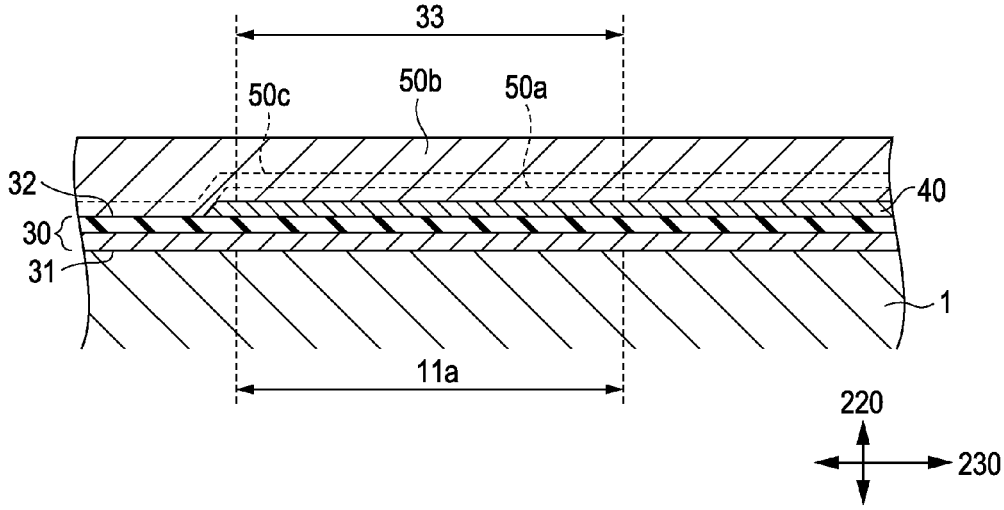
FIG. 4B is a sectional view that illustrates a process in the manufacturing method according to the exemplary embodiment of the invention.

In a case where lead zirconate titanate is used as the material of the piezoelectric substance layer 50*b* (piezoelectric substance layer 50), as illustrated in FIG. 4B, an intermediate titanium layer 50*c* may be formed partially on and partially over the entire second surface 32 of the diaphragm plate 30, followed by the applying of a precursor that is a piezoelectric material thereto. By this means, during the crystal growth of the piezoelectric substance layer 50*b* that is caused by the heat treatment of the precursor, the intermediate titanium layer 50*c* offers a uniform interface for the growth. In other words, there is no part of the piezoelectric substance layer 50*b* that grows on the diaphragm plate 30. Therefore, the controllability of the crystal growth of the piezoelectric substance layer 50*b* increases. Thus, the piezoelectric substance layer 50*b* is formed as piezoelectric crystal having greater orientation property. The intermediate titanium layer 50*c* forms into a part of the crystal of the piezoelectric substance layer 50*b* during the heating process.

Figure 5A:
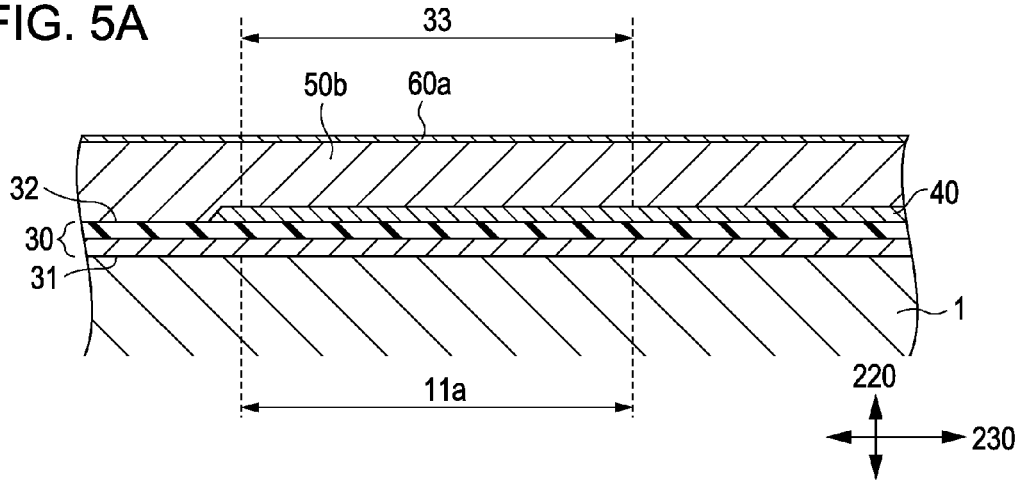
FIG. 5A is a sectional view that illustrates a process in the manufacturing method according to the exemplary embodiment of the invention.
Figure 5B:
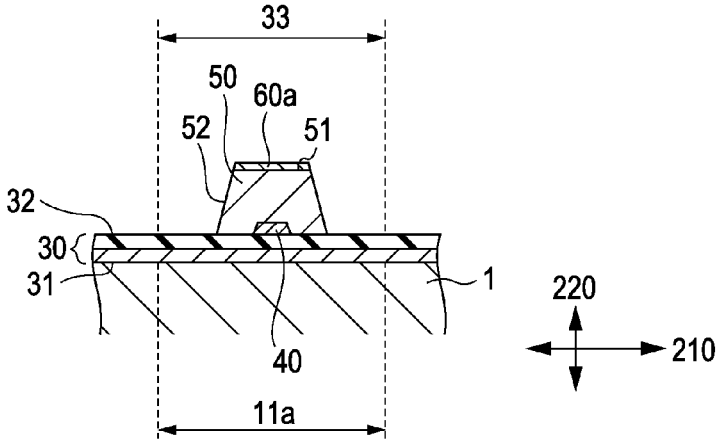
FIG. 5B is a sectional view that illustrates a process in the manufacturing method according to the exemplary embodiment of the invention.

Next, the piezoelectric substance layer 50*b* is etched for patterning. As illustrated in FIG. 5A, before the etching of the piezoelectric substance layer 50*b* to form the piezoelectric substance layer 50 having a desired pattern, a mask layer 60*a* that has electric conductivity may be formed on the piezoelectric substance layer 50*b*. The mask layer 60*a* is a metal layer that is made of the same material as that of a conductive layer 60*b*, which will be explained later. As illustrated in FIG. 5B, after the forming of the mask layer 60*a* on the piezoelectric substance layer 50*b*, the piezoelectric substance layer 50*b* is etched to form the piezoelectric substance layer 50 having a desired pattern. Since the mask layer 60*a* serves as a hard mask during the etching process, it is easy to form the tapered side surfaces 52 of the piezoelectric substance layer 50 as illustrated in FIG. 5B. The detailed structure of the piezoelectric substance layer 50 is not described here because it is explained earlier.

Figure 5C:
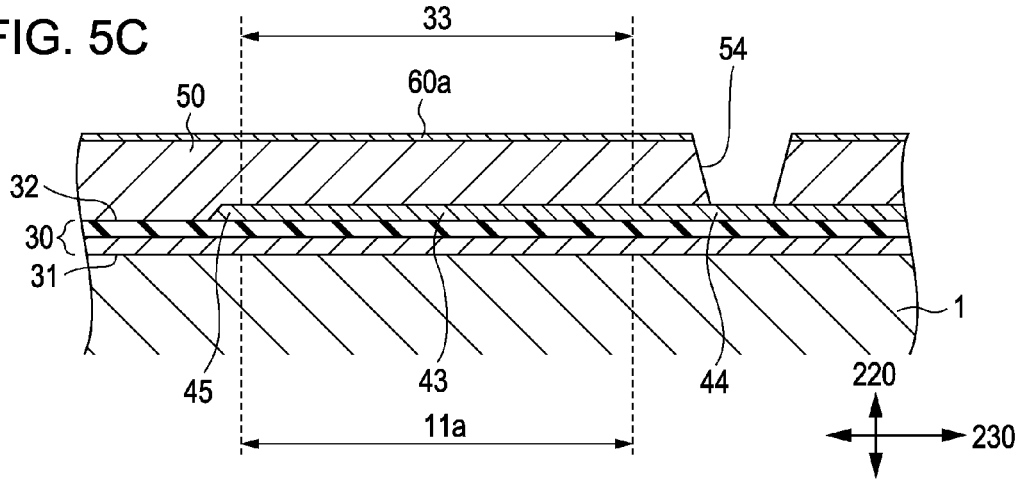
FIG. 5C is a sectional view that illustrates a process in the manufacturing method according to the exemplary embodiment of the invention.

When the piezoelectric substance layer 50 is formed by etching, as illustrated in FIG. 5C, the opening 54 is formed at the same time over the second conductive portion 44 of the first conductive layer 40 to expose a part of the second conductive portion 44 therethrough. The opening 54 is located over the second conductive portion 44 away from the second conductive layer 60.

Figure 6:
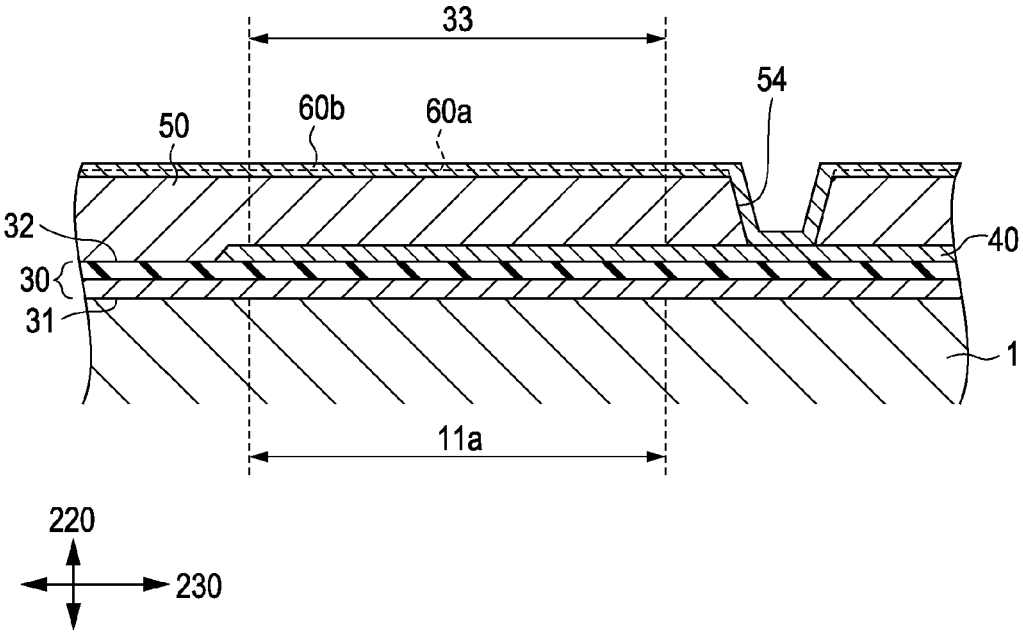
FIG. 6 is a sectional view that illustrates a process in the manufacturing method according to the exemplary embodiment of the invention.

Next, as illustrated in FIG. 6, the conductive layer 60*b* is formed in such a manner that it covers the piezoelectric substance layer 50 and the opening 54. The material of the conductive layer 60*b* is the same as that of the second conductive layer 60. A known technique for film deposition can be used to form the conductive layer 60*b*. For example, platinum, iridium, and the like may be deposited by using a sputtering method or the like to form the conductive layer 60*b*. If the mask layer 60*a* was formed in the preceding step, the conductive layer 60*b* and the mask layer 60*a* can turn into a single layer because the mask layer 60*a* is made of the same material as that of the conductive layer 60*b*.

Figure 7:
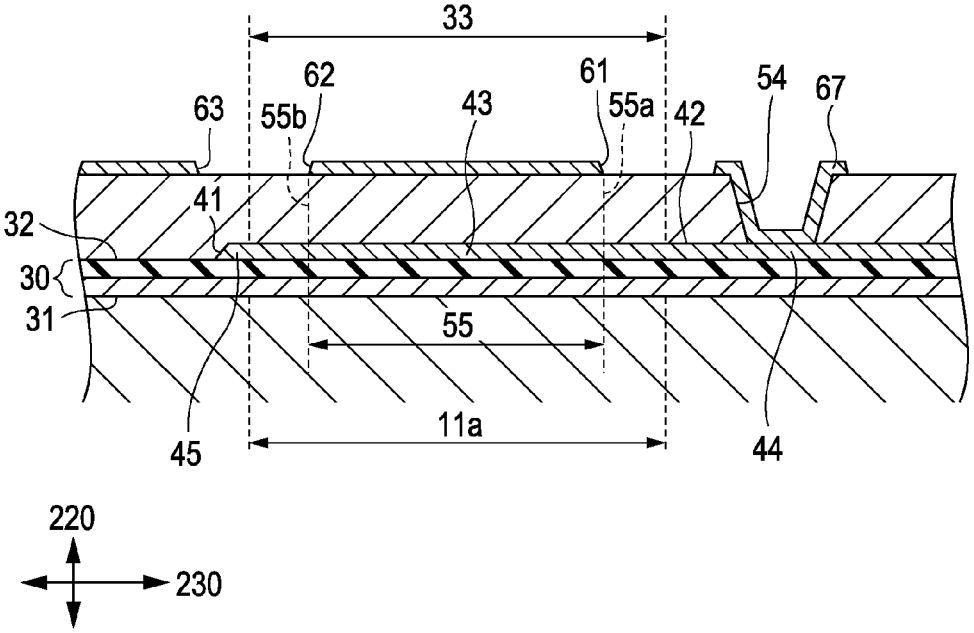
FIG. 7 is a sectional view that illustrates a process in the manufacturing method according to the exemplary embodiment of the invention.

Next, as illustrated in FIG. 7, the conductive layer 60*b* is etched to form the second conductive layer 60 having a desired pattern. Specifically, in this step, the conductive layer 60*b* is etched to form the second conductive layer 60 having the following pattern. In a view in the second direction 220, the second conductive layer 60 covers at least a part of the piezoelectric substance layer 50 in such a manner that the second conductive layer 60 lies over the first conductive layer 40 in the first direction 210 and lies over a part of the first conductive layer 40 in the third direction 230 at least inside each area that overlaps the first area surface 33. Moreover, in a view in the second direction 220, the second conductive layer 60, which is formed by the patterning of the conductive layer 60*b*, lies over the first conductive layer 40 formed at a plurality of areas. Furthermore, as illustrated in FIGS. 2A and 2E, the conductive layer 60*b* may be patterned in such a manner that the second conductive layer 60 has the extending portion 65*a* that extends toward one side in the third direction 230 and the extending portion 65*b* that extends toward the other side in the third direction 230. Each of the extending portions 65*a* and 65*b* is formed at least at, in a view in the second direction 220, a part of an area between the first conductive layer 40 that is formed at one area and the first conductive layer 40 that is formed at another area adjacent to the one area.

The second conductive layer 60 extends as a continuous layer that covers the piezoelectric substance layer 50 at each of a plurality of areas. The second conductive layer 60 is electrically connected to the common electrode, for example, through wiring that is not illustrated in the drawings. Since the second conductive layer 60 is formed as a continuous layer, it can function as a common upper electrode for the piezoelectric element 100. The detailed structure of the second conductive layer 60 is not described here because it is explained earlier. Since the second conductive layer 60 has the pattern explained above, it is possible to form, over the upper surface 42 of the first conductive portion 43 of the first conductive layer 40, the driving area 55 whose one end is determined by the position of the end face 61 and the other end is determined by the position of the end face 62.

In the first conductive layer patterning step, the piezoelectric substance layer patterning step, the second conductive layer patterning step, the layers are patterned in such a manner that at least one of the first conductive layer 40, the second conductive layer 60, and the piezoelectric substance layer 50 covers the diaphragm plate 30 in a view in the second direction 220. Therefore, the over-etching of the diaphragm plate 30 does not occur during the production process. Thus, the liquid droplet discharging head 300 offers improved durability.

In the second conductive layer patterning step, as illustrated in FIG. 7, the conductive layer 60*b* may be patterned in such a manner that it covers at least the opening 54. That is, the third conductive layer 67 may be formed as a part of the conductive layer 60*b* that is left without being etched away over the opening 54. Such a structure offers the following advantages. For example, after the application of resist thereto, light exposure processing and development processing is performed to form a resist film. Etching is performed while using the resist film as a mask. An organoalkaline liquid developer, an organic liquid remover, cleaning liquid, and the like are used for etching. Since a part of the conductive layer 60*b* remains without being removed over the opening 54, in other words, since the third conductive layer 67 is formed, it is possible to eliminate the risk of the over-etching of the surface of the first conductive layer 40 inside the opening 54. Moreover, it is possible to prevent the part of the first conductive layer 40 exposed through the opening 54 from being chemically damaged due to exposure to the organic liquid remover, the cleaning liquid, or the like after the etching process. Note that the third conductive layer 67 is not an indispensable component in the manufacturing method according to the present embodiment of the invention. Therefore, the conductive layer 60*b* formed over the opening 54 may be removed together so that the third conductive layer 67 is not formed.

Figure 8:
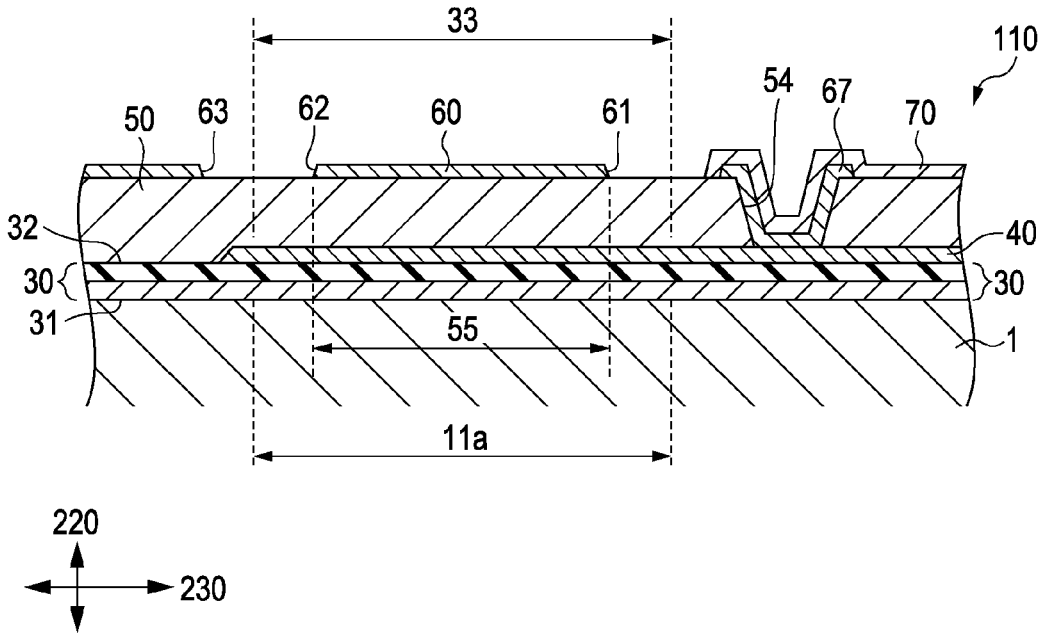
FIG. 8 is a sectional view that illustrates a process in the manufacturing method according to the exemplary embodiment of the invention.

Next, as illustrated in FIG. 8, the fourth conductive layer 70 is formed in such a manner that it covers at least the opening 54. If the third conductive layer 67 was formed in the preceding step, it suffices that the fourth conductive layer 70 is electrically connected to the third conductive layer 67. A known technique for film deposition can be used to form the fourth conductive layer 70. For example, the fourth conductive layer 70 can be formed as follows. Gold, nickel-chromium alloy, and the like are deposited by using a sputtering method or the like to form a conductive layer (not shown). The conductive layer is etched into the fourth conductive layer 70 having a predetermined pattern. The fourth conductive layer 70 may be electrically connected to an external driving circuit that is not illustrated in the drawings.

Figure 9A:
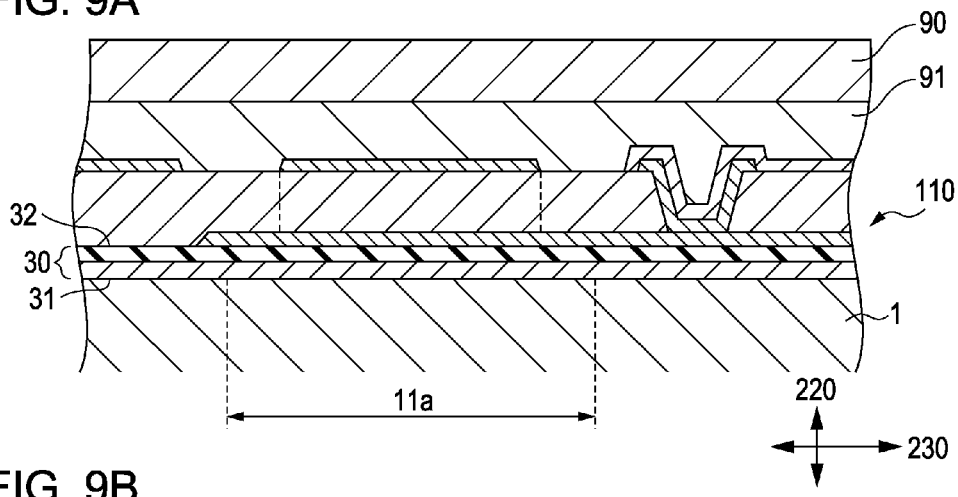
FIG. 9A is a sectional view that illustrates a process in the manufacturing method according to the exemplary embodiment of the invention.
Figure 9B:
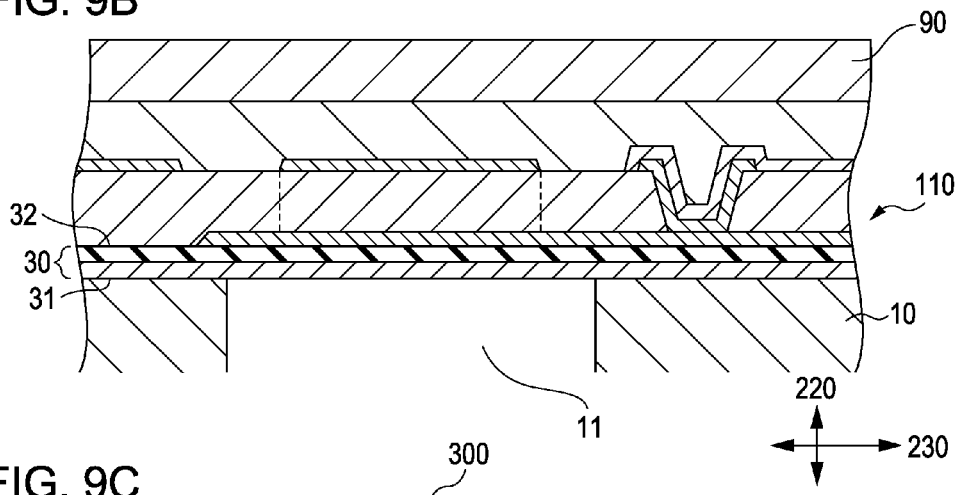
FIG. 9B is a sectional view that illustrates a process in the manufacturing method according to the exemplary embodiment of the invention.
Figure 9C:
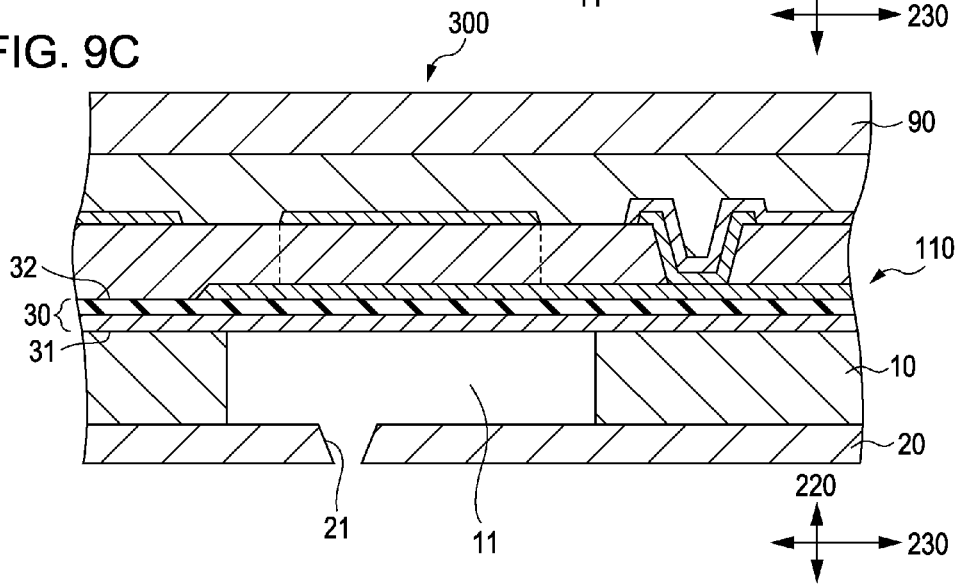
FIG. 9C is a sectional view that illustrates a process in the manufacturing method according to the exemplary embodiment of the invention.

As illustrated in FIG. 9A, the sealing plate 90 having the sealing space 91 is mounted from above the piezoelectric element 100. The piezoelectric element 100 can be enclosed in the sealing space 91. For example, an adhesive may be used to seal the piezoelectric element 100 inside the sealing plate 90. Next, as illustrated in FIG. 9B, the thickness of the substrate 1 is reduced to a predetermined value. Then, the pressure chambers 11 are formed as compartments inside the thinned substrate 1. Other passages and the like are also formed inside the substrate 1. For example, a mask (not shown) is formed on a surface of the substrate 1 having a predetermined thickness. The surface on which the mask is formed is opposite to the surface on which the diaphragm plate 30 is disposed. Etching is performed while using the mask to form the pressure chambers 11. The liquid supplying passages 13, the communication passages 14, and the reservoir 15, which are not illustrated in FIG. 9, are also formed inside the thinned substrate 1. In this way, the pressure chamber substrate 10 having the pressure chambers 11 can be manufactured beneath or under the diaphragm plate 30. After the manufacturing of the pressure chamber substrate 10, as illustrated in FIG. 9C, the nozzle plate 20 having the nozzle holes 21 is attached to the pressure chamber substrate 10 at a predetermined attachment position by using, for example, an adhesive. Each of the nozzle holes 21 is in communication with the corresponding one of the pressure chambers 11.

The liquid droplet discharging head 300 can be manufactured by using, for example, the method described above. As explained earlier, the method for manufacturing the liquid droplet discharging head 300 is not limited to the above example. For example, an electroforming method or the like may be used to manufacture the pressure chamber substrate 10 and the nozzle plate 20 as a single member.

2. Liquid Droplet Discharging Apparatus

Figure 10:
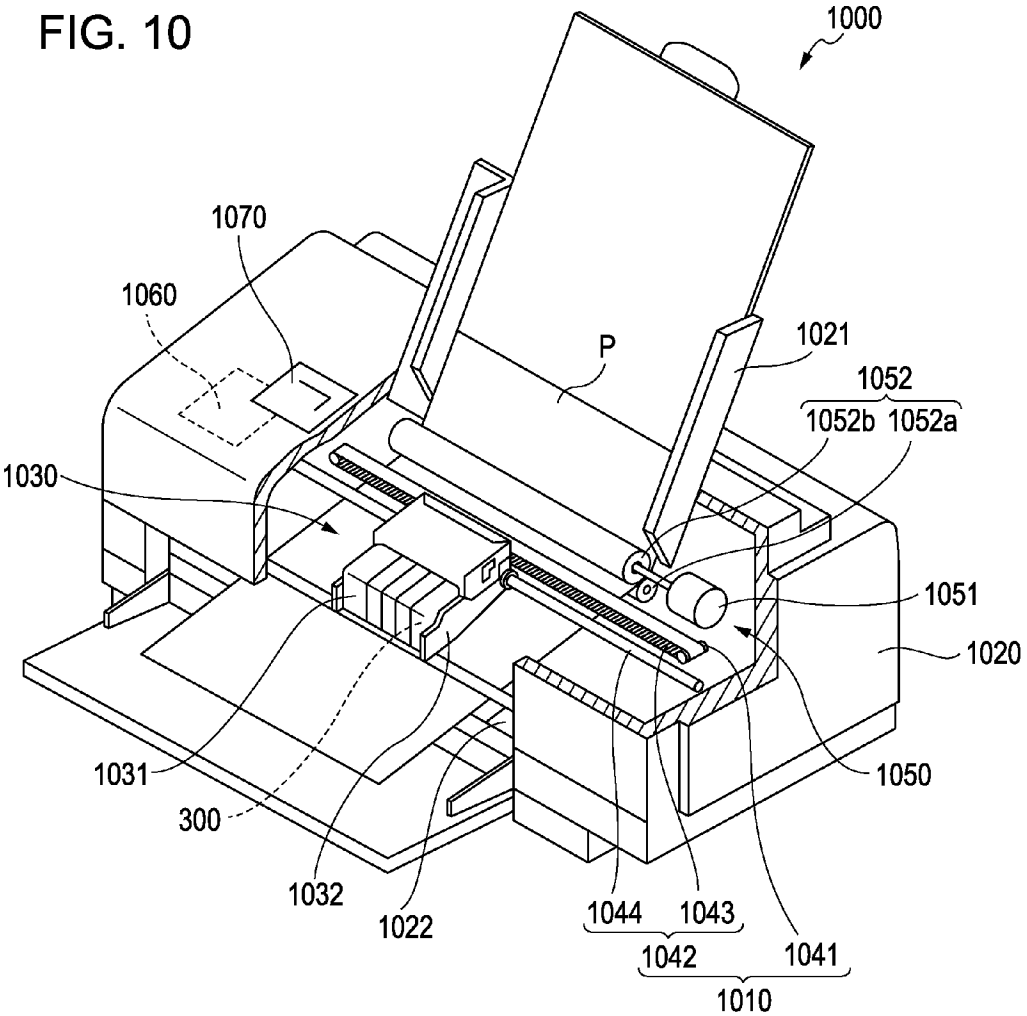
FIG. 10 is a perspective view that schematically illustrates an example of the configuration of a liquid droplet discharging apparatus according to an exemplary embodiment of the invention.

Next, a liquid droplet discharging apparatus according to the present embodiment of the invention will now be explained. A liquid droplet discharging apparatus according to the present embodiment of the invention is equipped with the liquid droplet discharging head explained above. In the following description, an ink-jet printer is taken as an example of a liquid droplet discharging apparatus 1000 according to the present embodiment of the invention. FIG. 10 is a perspective view that schematically illustrates an example of the configuration of the liquid droplet discharging apparatus 1000 according to the present embodiment of the invention.

The liquid droplet discharging apparatus 1000 includes a head unit 1030, a driving unit 1010, and a control unit 1060. The liquid droplet discharging apparatus 1000 further includes an apparatus body 1020, a paper-feed unit 1050, a tray 1021 on which sheets of printing paper P are stacked, an ejection port 1022 through which the paper P is ejected, and an operation panel 1070 that is provided at the upper surface of the apparatus body 1020.

The head unit 1030 includes an ink-jet recording head (hereinafter may be simply referred to as head), which is the liquid droplet discharging head 300 explained above. Besides the ink-jet recording head, the head unit 1030 includes ink cartridges 1031 and a carrying unit (i.e., carriage) 1032. Ink is supplied to the head from the ink cartridges 1031. The head is mounted on the carrying unit 1032. The ink cartridges 1031 are detachably attached to the carrying unit 1032.

The driving unit 1010 can reciprocate the head unit 1030. The driving unit 1010 includes a carriage motor 1041 and a reciprocation mechanism 1042. The carriage motor 1041 supplies power for driving the head unit 1030. The reciprocation mechanism 1042 causes the head unit 1030 to move in a reciprocating motion.

The reciprocation mechanism 1042 includes a carriage-guiding shaft 1044 and a timing belt 1043. A frame that is not illustrated in the drawings supports the carriage-guiding shaft 1044. The timing belt 1043 is stretched in parallel to the carriage-guiding shaft 1044. The carriage-guiding shaft 1044 supports the carrying unit 1032 while allowing the carrying unit 1032 to reciprocate freely. The carrying unit 1032 is attached to a part of the timing belt 1043. When the carriage motor 1041 is driven, the timing belt 1043 runs. As the timing belt 1043 runs, the head unit 1030 reciprocates along the carriage-guiding shaft 1044. The head ejects ink during the reciprocation of the head unit 1030. In this way, an image or the like is printed on a sheet of printing paper P.

The control unit 1060 can control the head unit 1030, the driving unit 1010, and the paper-feed unit 1050.

The paper-feed unit 1050 can pick up a sheet of printing paper P from the tray 1021 and feed the printing paper P toward the head unit 1030. The paper-feed unit 1050 includes a paper-feed motor 1051 and a paper-feed roller 1052. The paper-feed motor 1051 supplies power for driving the paper-feed roller 1052. The paper-feed roller 1052 rotates when driven by the paper-feed motor 1051. The paper-feed roller 1052 includes a pair of rollers, that is, a driven roller 1052*a* and a driving roller 1052*b*. The driven roller 1052*a* is provided as a lower roller. The driving roller 1052*b* is provided as an upper roller. The driven roller 1052*a* and the driving roller 1052*b* are provided opposite to each other with a feeding path of the printing paper P being interposed between the driven roller 1052*a* and the driving roller 1052*b*. The driving roller 1052*b* is connected to the paper-feed motor 1051. When driven by the control unit 1060, the paper-feed unit 1050 feeds the printing paper P. The printing paper P passes through an area beneath or under the head unit 1030.

The head unit 1030, the driving unit 1010, the control unit 1060, and the paper-feed unit 1050 are provided inside the apparatus body 1020.

The liquid droplet discharging apparatus 1000 is equipped with the liquid droplet discharging head 300, which offers improved durability. Therefore, the liquid droplet discharging apparatus 1000 offers improved durability.

In the above example, an ink-jet printer is taken as an example of the liquid droplet discharging apparatus 1000. However, it is not limited to an ink-jet printer. As another example of various applications, an apparatus described herein can be used as an industrial liquid droplet discharging apparatus. A fluid substance in which any of various kinds of functional materials is dissolved in a solvent or dispersed in a dispersion medium to have moderate viscosity, a fluid substance that contains metal flakes, or the like can be used as liquid (a liquid material) to be ejected.

Although a detailed explanation is given above while describing an exemplary embodiment of the invention, a person skilled in the art can easily understand that the invention is not limited to the exemplary embodiment and the variation examples described herein and that the invention may be modified, altered, changed, adapted, and/or improved within a range not departing from the gist and/or spirit of the invention, including its novel and inventive features as well as unique advantageous effects thereof, as apprehended from explicit and implicit description made herein. Such a modification, an alteration, a change, an adaptation, and/or an improvement are also covered by the scope of the appended claims.

What is claimed is:

1. A liquid droplet discharging head comprising:

a pressure chamber substrate in which a pressure chamber that is in communication with a nozzle hole is formed, the pressure chamber being formed in the pressure chamber substrate as a plurality of compartments adjacent to one another in a first direction;

a vibrating plate that has a first surface for covering the pressure chamber and a second surface as an opposite surface, the vibrating plate having a first area surface as a part of the first surface, the first area surface covering the pressure chamber in a view in a second direction that is orthogonal to the first direction and is normal to the first surface;

a first conductive layer that is formed at a plurality of areas to cover, in a view in the second direction, the second surface of the vibrating plate inside each area that overlaps the first area surface in the first direction and, in a view in the second direction, extends from the area overlapping the first area surface to an area that is located outside the area overlapping the first area surface at least one side in a third direction to cover the second surface thereat, the third direction being orthogonal to both the first direction and the second direction, wherein at least a portion of the first conductive layer contacts at least a portion of the vibrating plate;

a piezoelectric substance layer that covers the first conductive layer at least inside the area overlapping the first area surface in a view in the second direction; and a second conductive layer that covers, in a view in the second direction, at least a part of the piezoelectric substance layer in such a manner that the second conductive layer lies over the first conductive layer in the first direction and lies over a part of the first conductive layer in the third direction at least inside the area overlapping the first area surface, the second conductive layer lying over the first conductive layer formed at the plurality of areas in a view in the second direction, wherein at least one of the first conductive layer, the second conductive layer, and the piezoelectric substance layer covers the vibrating plate in a view in the second direction, and wherein at least a portion of the second conductive layer contacts at least a portion of the vibrating plate.

2. The liquid droplet discharging head according to claim 1, wherein, regarding two arbitrary areas of the first area surface that are formed adjacent to each other, the piezoelectric substance layer is not formed at an area including at least a part of an area between one of the two areas and the other in a view in the second direction.

3. The liquid droplet discharging head according to claim 2, wherein an area where the piezoelectric substance layer is not formed is located in a regional range between one end of the first area surface in the third direction and the other end of the first area surface in the third direction in a view in the second direction.

4. The liquid droplet discharging head according to claim 1, wherein the second conductive layer has extending portions that extend toward both sides in the third direction; and each of the extending portions is formed at least at, in a view in the second direction, a part of an area between the first conductive layer that is formed at one area and the first conductive layer that is formed at another area adjacent to the one area.

5. The liquid droplet discharging head according to claim 1, wherein the extending portions extend beyond ends of the first area surface in the third direction in a view in the second direction.

6. The liquid droplet discharging head according to claim 1, wherein the extending portions are formed at positions at which the extending portions do not overlap the first area surface at all in a view in the second direction.

7. The liquid droplet discharging head according to claim 1, wherein the area where the first conductive layer and the second conductive layer overlap each other is formed symmetrically in a regional range between one end of the first area surface and the other end in the third direction with respect to the first direction, which is taken as an axis of symmetry, in a view in the second direction; and the extending portions are symmetric with respect to the first direction taken as the axis of symmetry in the regional range between the one end of the first area surface and the other end in the third direction in a view in the second direction.

8. The liquid droplet discharging head according to claim 1, wherein the second conductive layer is electrically connected to a common electrode; and at least a part of the extending portions is electrically connected to the common electrode at an extension end.

9. A liquid droplet discharging apparatus that includes the liquid droplet discharging head according to claim 1.

* * * * *